US007938712B2

(12) United States Patent
Maricevic et al.

(10) Patent No.: US 7,938,712 B2
(45) Date of Patent: May 10, 2011

(54) METHODS AND APPARATUS FOR DECORATIVE BRA STRAPS WITH MULTIPLE USES

(76) Inventors: Jelica Maricevic, West Hartford, CT (US); Dianne Caezza, Farmington, CT (US)

( * ) Notice: Subject to any disclaimer, the term of this patent is extended or adjusted under 35 U.S.C. 154(b) by 21 days.

(21) Appl. No.: 12/290,628

(22) Filed: Nov. 1, 2008

(65) Prior Publication Data

US 2009/0130954 A1 May 21, 2009

Related U.S. Application Data

(60) Provisional application No. 61/001,469, filed on Nov. 1, 2007.

(51) Int. Cl.
*A41C 3/00* (2006.01)

(52) U.S. Cl. ..... 450/86; 2/338

(58) Field of Classification Search ..... 450/86, 450/1; 2/1, 105, 106, 73, 67, 336, 338, 326–331, 2/311, 312, 310, 78.1–78.4; D2/700, 701, 703, 706, 708, 731, 734, 793
See application file for complete search history.

(56) References Cited

U.S. PATENT DOCUMENTS

| | | | | |
|---|---|---|---|---|
| 6,086,451 | A * | 7/2000 | Fernandes | 450/86 |
| 6,186,861 | B1 * | 2/2001 | Flaherty | 450/1 |
| 6,517,409 | B2 * | 2/2003 | Flaherty | 450/1 |
| 7,396,273 | B2 * | 7/2008 | Styles-Gaviria et al. | 450/86 |
| 7,513,816 | B1 * | 4/2009 | McCullough et al. | 450/86 |

* cited by examiner

*Primary Examiner* — Gloria Hale
(74) *Attorney, Agent, or Firm* — FSP LLC

(57) ABSTRACT

A decorative bra strap design—interchangeable bra strap/jewelry accessory is proposed. A semi-stretchable design is based on a non-stretchable beading core, that, attached at one or both end to a stretchable elastic section, that's in turn terminated into a jewelry-clasp type ending, that serves to attach to any kind of bras that have option of interchangeable bra straps, or to a "strapless" bra with hook loops. Numerous other aspects are provided.

8 Claims, 6 Drawing Sheets

METHODS AND APPARATUS FOR DECORATIVE BRA STRAPS WITH MULTIPLE USES

FIELD OF THE INVENTION

The present invention relates to decorative apparel, and in particular, relates to a method and apparatus for constructing decorative brasserie straps with multiple uses.

BACKGROUND

A brasserie, commonly referred to as a bra, is an article of clothing that is often considered an "undergarment". However, in the regions with warm climates, or in general during the hot summer months, when worn under tank tops, tube tops or other sleeveless shirts often the bra straps become exposed in often unsightly ways, thus migrating from an "undergarment" item to a much more exposed and scrutinized "top garment" status. One solution is to turn these often burdensome straps into a fashion statement. While decorative removable bra straps are already on the market, sometimes referred to as "shoulder jewelry" this invention proposes a way to construct such decorative bra straps into an interchangeable piece of jewelry for the neck, waist, wrist and ankle and can also be simply engineered into an eye glass chain.

DETAILED DESCRIPTION

This disclosure proposes an apparatus and a method of construction of an interchangeable bra strap/jewelry accessory.

Figure 1:
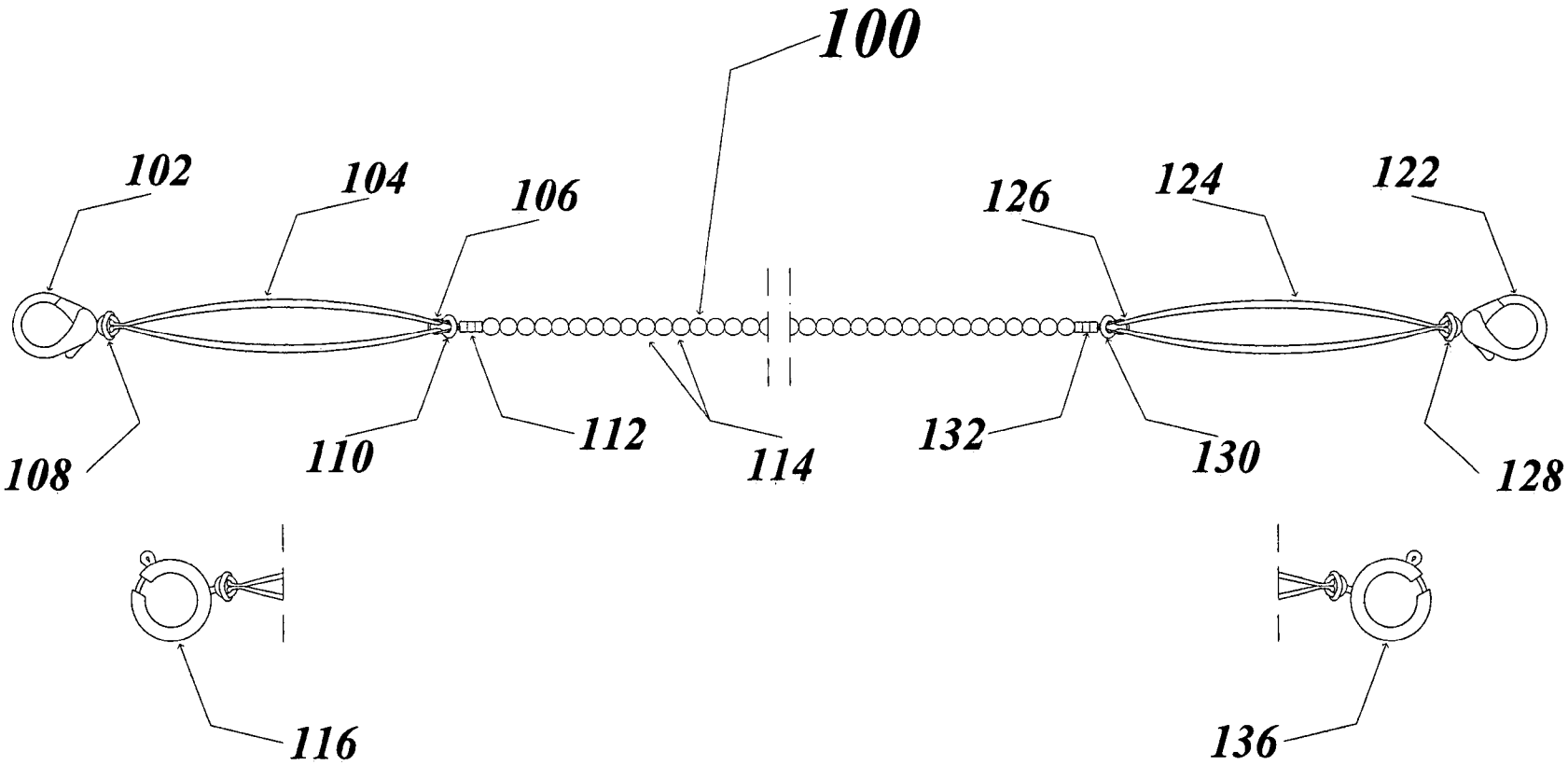
FIG. 1 shows a view of a completely constructed bra strap according to an embodiment of the present invention.

FIG. 1 shows a schematic perspective view of a single decorative bra strap, with its key elements highlighted. A semi-stretchable design of a decorative bra strap, where the core part 100 of the strap is based on a non-stretchable beading wire 106, 126, that's attached at one or both ends via knot 110, 130 to a stretchable elastic section 104 and 124, that is in turn terminated via knot 108, 128 into a jewelry clasp type (such as lobster clasp 102, 122 or spring clasp 116, 136; but not limited to), that serves to attach to any kind of bras that have option for interchangeable bra straps, or to a "strapless" bra with hook loops. This jewelry clasp 102, 122 (or 116, 136) is meant to replace the standard metal or plastic hook that is normally used to attach to the bra. Knots 108, 110, 130 and 128 are done, for example, as the "reef knots", but could be implemented as other types of knots. Decorative beads 114 are beaded on the beading wire 106, 126 that is press-crimped at its ends via plurality (typically 1 to 5) of the press-crimp beads 112, 132.

Figure 2A:
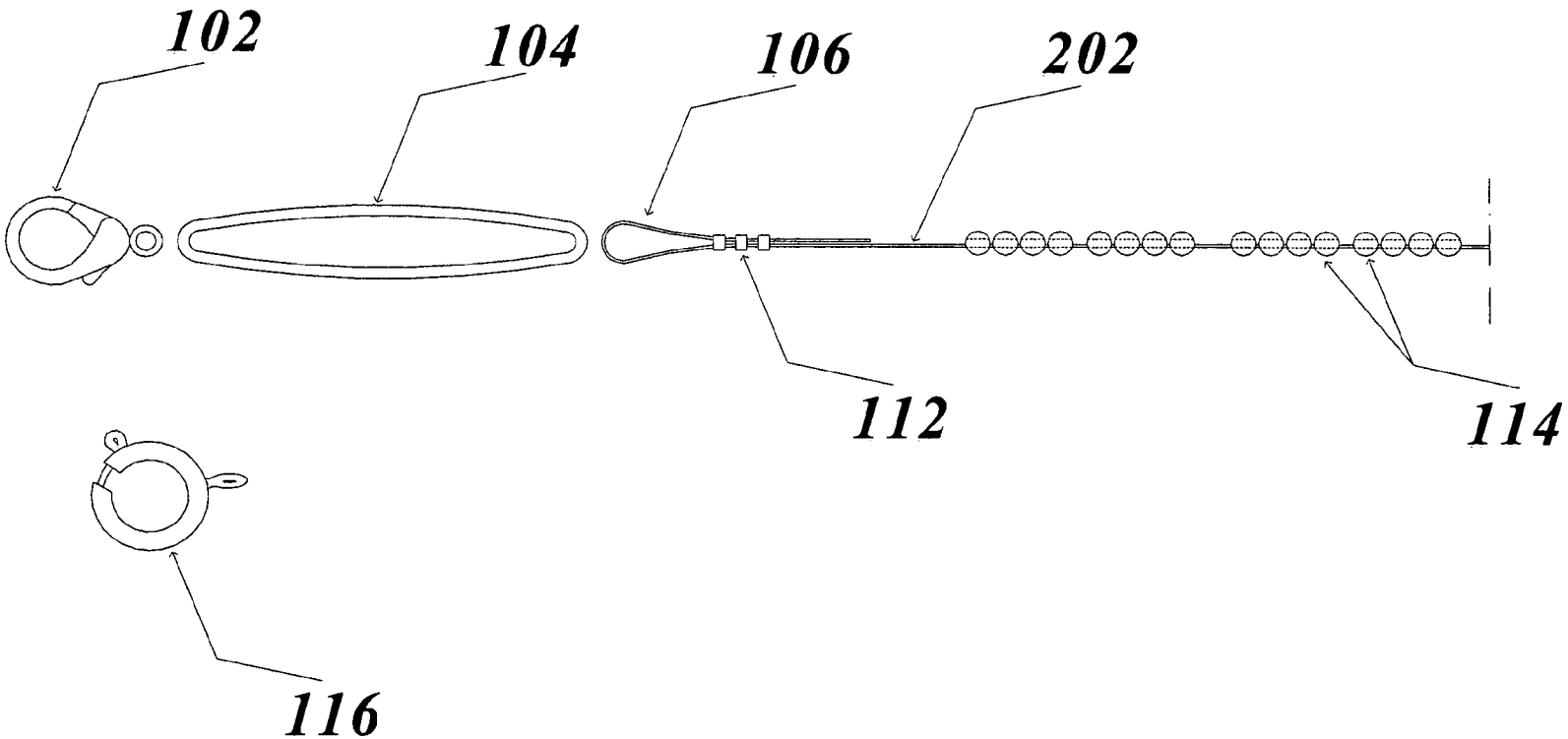
FIG. 2A shows a view of the key components for a bra strap end assembly containing a single beading wire, according to an embodiment of the present invention.

FIG. 2A shows a view of the key components for one end of the bra strap assembly. The beading wire 202 forms the core for beading a variety of decorative beads 114 that are for example made out of glass, crystal, gems, metal or wood; but not limited to. Once the decorative beads are mounted on the beading wire 200, the beading wire end is formed into a loop 106 and looped back through the crimp-beads 112, which are then press-crimped into place. In order to achieve a robust and reliable fixation, a plurality (typically 1 to 5, preferably at least 3) of press-crimp beads are lined up next to each other and then press-crimped in place/attached to the looped beading wire. An elastic loop 104 is then knotted through the beading wire loop 106. Finally, a jewelry clasp, of "lobster-clasp" type 102 or "spring-clasp" type 116 is knotted with the other end of the elastic loop 104. In order to increase the stretch-ability of the design, usage of serially knotted-to-each-other cascade of the string loops 104 is also envisioned. Beading wire 202 can also be implemented as a "fish-line" wire or replaced by a fully-stretchable band of elastic type of material.

Figure 2B:
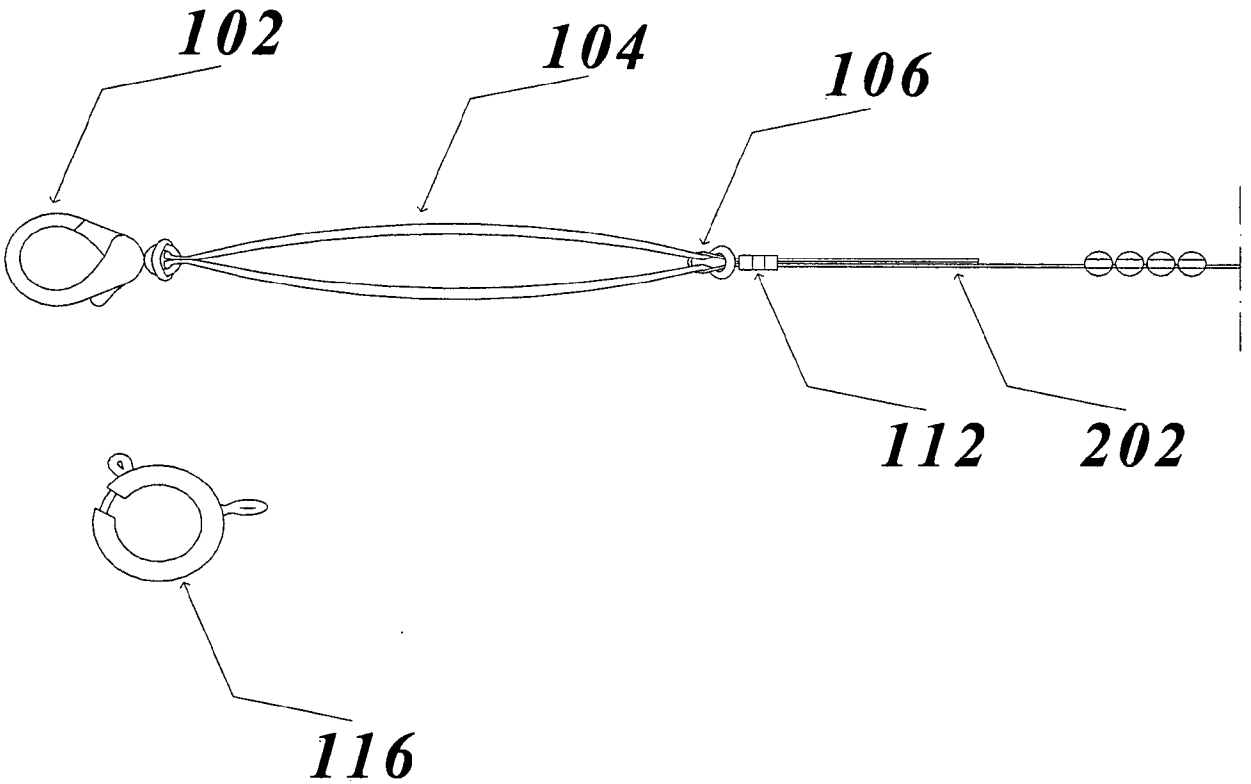
FIG. 2B is a view of the assembled key components for a bra strap end assembly containing a single beading wire, according to an embodiment of the present invention.

FIG. 2B shows a view of the assembled key components for a bra strap end assembly containing a single beading wire 202. Crimp-beads 112 are crimped in place, the loop end 106 of the beading wire 202 is knotted in place with the elastic 104, in turn knotted in place with the jewelry clasp 102 (or with the spring-clasp 116)

Figure 2C:
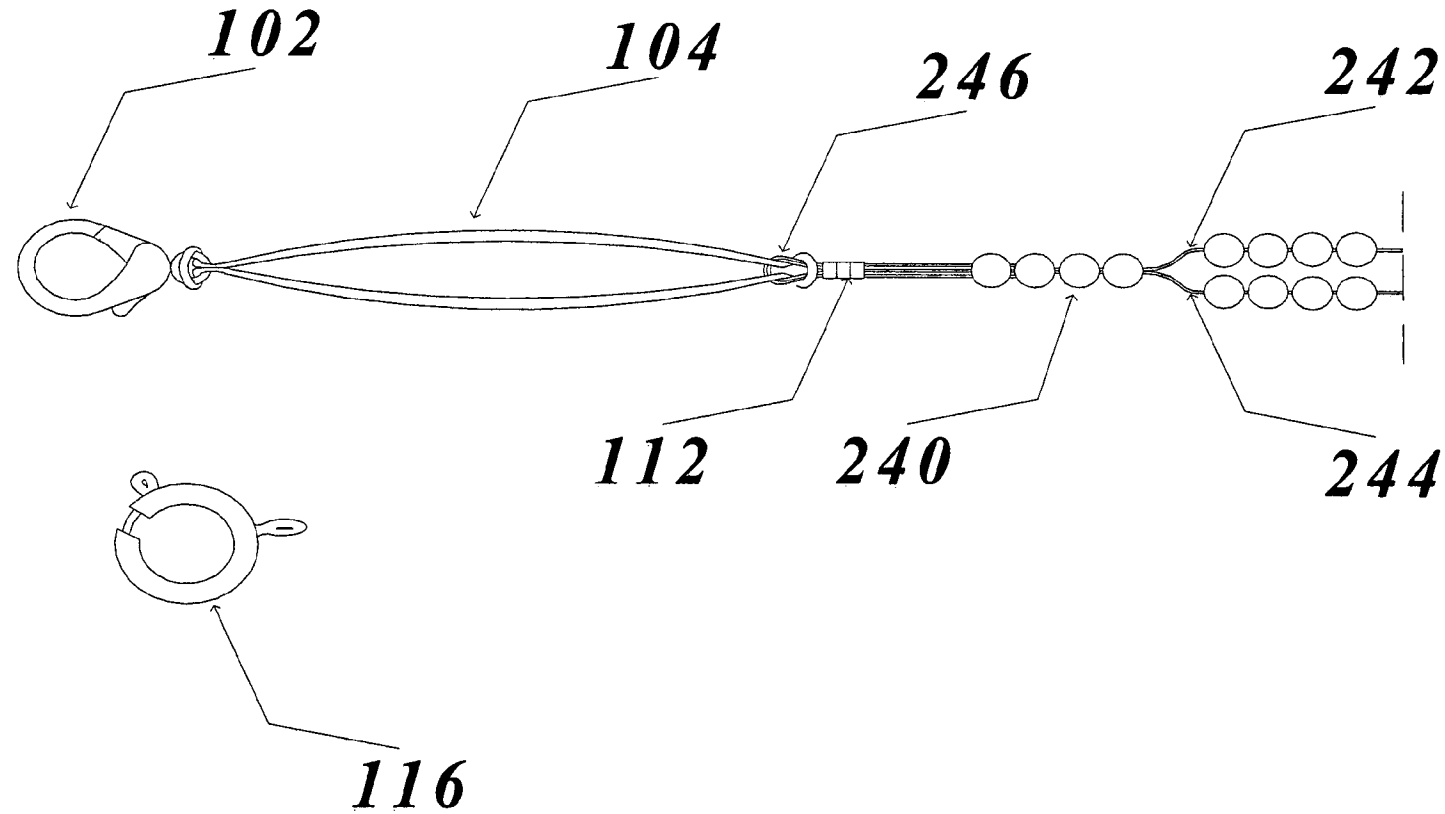
FIG. 2C is a view of the assembled key components for a bra strap end assembly containing plurality of beading wires, according to an embodiment of the present invention.

FIG. 2C shows a view of the assembled key components for a bra strap end assembly containing plurality (two wires 242, 244 are shown) of the beading wires. Crimp-beads 112 are crimped in place, the plurality-loop end 246 of the beading wires 242, 244 is knotted in place with the elastic 104, in turn knotted in place with the jewelry clasp 102 (or with the spring-clasp 116)

Figure 3:
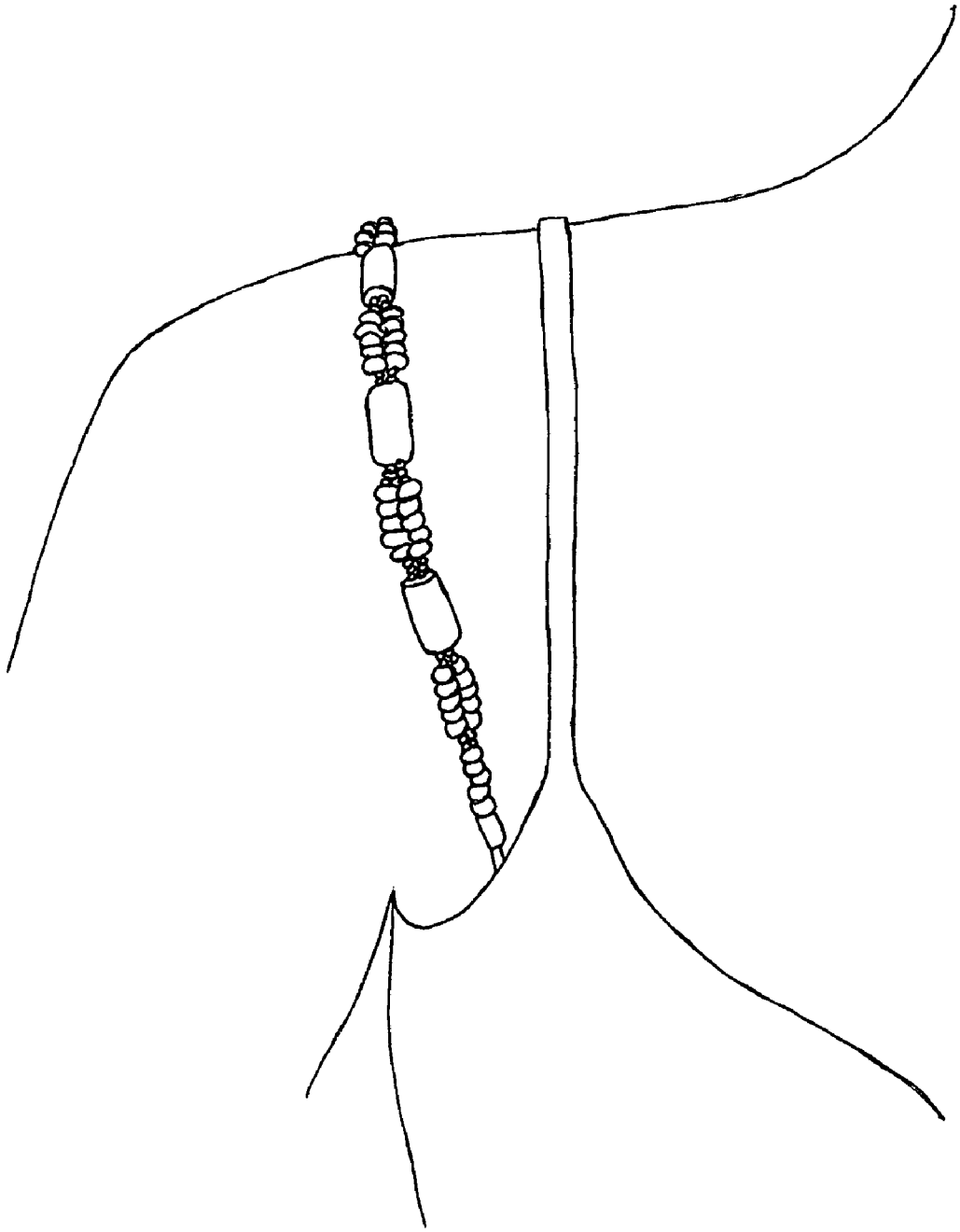
FIG. 3 is a photograph of a brasserie strap according to an embodiment of the present invention.
Figure 4:
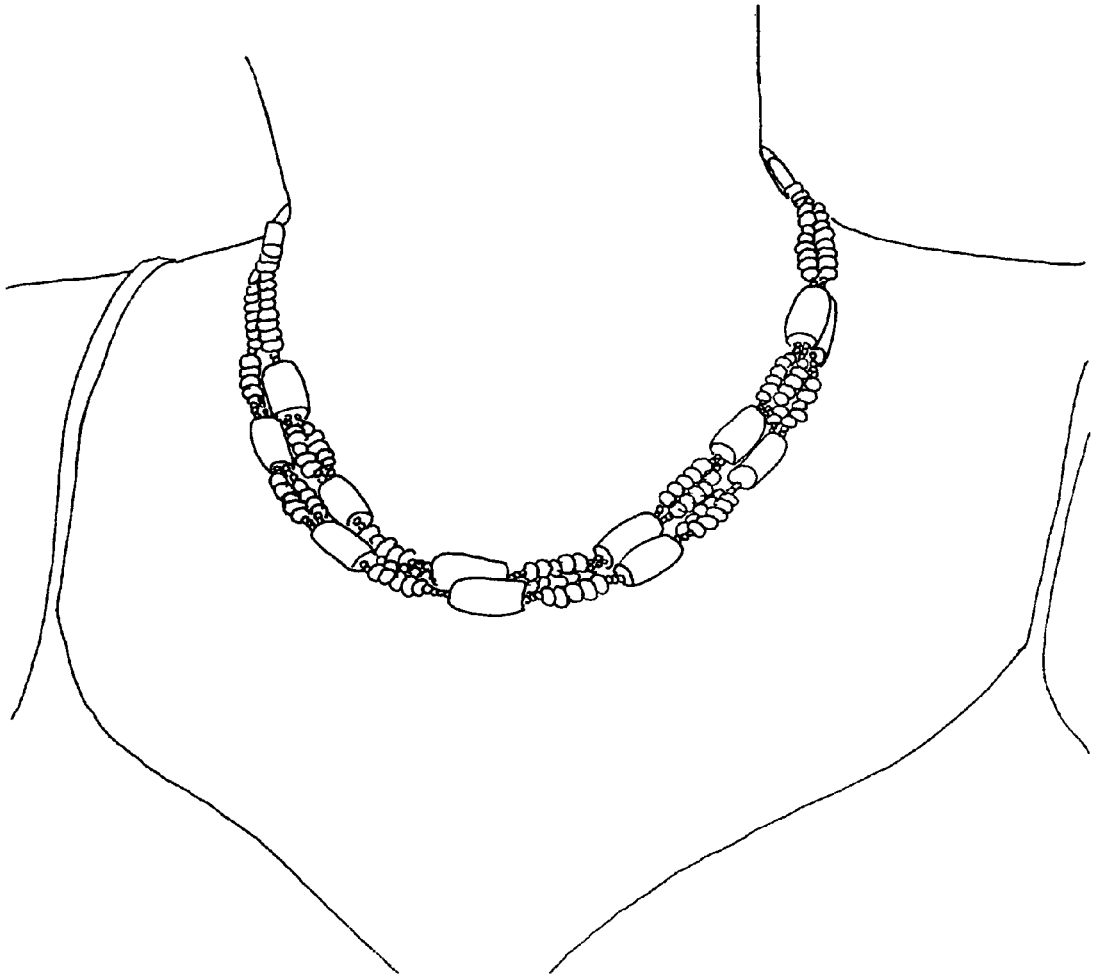
FIG. 4 is a photograph of the same strap utilized as the neck jewelry, according to an embodiment of the present invention.

FIG. 3 is a photograph of a bra strap, according to an embodiment of the present invention. FIG. 4 is a photograph of the same strap utilized as the neck jewelry. As these photographs indicate, the jewelry-clasp ending of the decorative bra strap design allows for versatile use or the decorative bra straps, neck jewelry being just one example.

The foregoing description discloses only exemplary embodiments of the invention. Modifications of the above disclosed apparatus and methods which fall within the scope of the invention will be readily apparent to those of ordinary skill in the art.

Accordingly, while the present invention has been disclosed in connection with exemplary embodiments thereof, it should be understood that other embodiments may fall within the spirit and scope of the invention, as defined by the following claims.

What is claimed is:

1. A bra strap, comprising:

a first bra strap elastic section;

a second bra strap elastic section; and an intermediate section of inelastic line between the elastic sections, the intermediate section of inelastic line comprising a plurality of beaded elements;

a first end of the first elastic section coupled to the inelastic line and a second end of the first elastic section coupled to a first clasp; and a first end of the second elastic section coupled to the inelastic line and a second end of the second elastic section coupled to a second clasp.

2. The bra strap of claim 1, further comprising:

each one of the elastic sections attached to a lobster clasp.

3. The bra strap of claim 1, further comprising:

each elastic section being ⅙ or less of the length of the inelastic section.

4. A bra comprising:

a pair of cups; and a pair of bra straps, each bra strap comprising a first bra strap elastic section; a second bra strap elastic section; and an intermediate section of inelastic line between the elastic sections, the intermediate section of inelastic line comprising a plurality of beaded elements;

each elastic section of each strap coupled to a clasp.

5. The bra of claim 4, further comprising:

at least one of the elastic sections attached to a lobster clasp.

6. The bra of claim 4, further comprising:

each elastic section being ⅙ or less of the length of the inelastic section.

7. The bra strap of claim 1, wherein one or both of the first and second elastic sections are elastic loops.

8. The bra of claim 4, wherein one or both of the first and second elastic sections are elastic loops.

* * * * *